US011591810B2

(12) United States Patent
Ehsani

(10) Patent No.: US 11,591,810 B2
(45) Date of Patent: Feb. 28, 2023

(54) REUSABLE AND ADJUSTABLE-SIZE FORM FOR REPAIR AND REINFORCEMENT OF STRUCTURES

(71) Applicant: Mohammad R. Ehsani, Tucson, AZ (US)

(72) Inventor: Mohammad R. Ehsani, Tucson, AZ (US)

( * ) Notice: Subject to any disclaimer, the term of this patent is extended or adjusted under 35 U.S.C. 154(b) by 162 days.

(21) Appl. No.: 16/993,102

(22) Filed: Aug. 13, 2020

(65) Prior Publication Data

US 2022/0049509 A1 Feb. 17, 2022

(51) Int. Cl.

| | |
|---|---|
| ***E04G 9/08*** | (2006.01) |
| ***E04G 23/02*** | (2006.01) |
| ***E04G 13/02*** | (2006.01) |

(52) U.S. Cl.

CPC ..... *E04G 9/08* (2013.01); *E04G 13/021* (2013.01); *E04G 23/0218* (2013.01)

(58) Field of Classification Search

CPC ..... E04G 9/08; E04G 13/021; E04G 23/0218; E04G 23/0225

See application file for complete search history.

(56) References Cited

U.S. PATENT DOCUMENTS 3,257,767 A * 6/1966 Lassy ..... E04C 5/18 D8/382
3,956,437 A * 5/1976 Ellis ..... E04G 13/021 264/32
4,749,165 A * 6/1988 Moraca ..... E04G 13/021 249/48
5,328,142 A * 7/1994 Weekers ..... E04G 13/021 249/DIG. 2
5,337,699 A * 8/1994 Dyson ..... A01K 1/10 119/60
5,551,662 A * 9/1996 Keady ..... E04G 21/1841 249/48
2009/0108170 A1* 4/2009 Penza ..... E04G 13/02 249/173
2009/0232606 A1* 9/2009 Penza ..... E04G 13/02 405/257
2013/0270727 A1* 10/2013 Bauer-Juarez ..... B28B 7/342 264/32
2014/0183330 A1* 7/2014 Simmons ..... E04G 13/00 249/49

FOREIGN PATENT DOCUMENTS

| | | | | |
|---|---|---|---|---|
| CA | 2593928 A1 * | 1/2008 | ..... | B31C 3/00 |
| CN | 106894647 A * | 6/2017 | | |
| DE | 3121418 A1 * | 12/1982 | | |
| EP | 593009 A1 * | 4/1994 | ..... | E04G 13/02 |
| FR | 2646868 A3 * | 5/1990 | | |
| GB | 2337479 A * | 11/1999 | ..... | B29C 39/10 |

* cited by examiner

*Primary Examiner* — Babajide A Demuren

(74) *Attorney, Agent, or Firm* — Arjomand Law Group, PLLC

(57) ABSTRACT

A method and an article of manufacture are disclosed for constructing, reinforcing, and repairing various structural elements such as columns, piles and the like using formworks that are reusable. The reusable articles of manufacture employed in the disclosed methods are or, if desired, may be permanently left in place. Same or similar methods and articles of manufacture may be employed to easily construct pipes of any desired diameter in a very short time.

11 Claims, 11 Drawing Sheets

REUSABLE AND ADJUSTABLE-SIZE FORM FOR REPAIR AND REINFORCEMENT OF STRUCTURES

CROSS-REFERENCE(S) TO RELATED APPLICATION(S)

This application is a Divisional of, and claims the benefit of the filing date of, U.S. patent application Ser. No. 15/665,098 under 35 USC § 120. The U.S. patent application Ser. No. 15/665,098, under 35 U.S.C. § 119, had claimed the benefit of the filing date of the U.S. Provisional Patent Application 62/551,397, entitled "Spiral-Wound Jackets for Repair of Piles," filed on 1 Jan. 2017; and of the U.S. Provisional Patent Application 62/355,775, entitled "Reusable Construction Formwork," filed on 28 Jun. 2016; and of the U.S. Provisional Patent Application 62/441,992, entitled "Spiral-Wound Reusable Concrete Form," filed on 4 Jan. 2017, the specifications of all of which are incorporated herein in their entirety by reference.

TECHNICAL FIELD

This application relates generally to construction methods and apparatus. More specifically, this application relates to a method and a reusable apparatus for repairing and/or reinforcing pillars and columns and for repairing pipes of any desired diameter on site, using reusable materials.

BRIEF DESCRIPTION OF THE DRAWINGS

The drawings, when considered in connection with the following description, are presented for the purpose of facilitating an understanding of the subject matter sought to be protected.

DETAILED DESCRIPTION

While the present disclosure is described with reference to several illustrative embodiments described herein, it should be clear that the present disclosure should not be limited to such embodiments. Therefore, the description of the embodiments provided herein is illustrative of the present disclosure and should not limit the scope of the disclosure as claimed. In addition, while the following description references using only a few wrapper designs, it will be appreciated that the disclosure includes many more wrapper designs and methods of wrapping the reusable wrapper around the workpiece.

Figure 1:
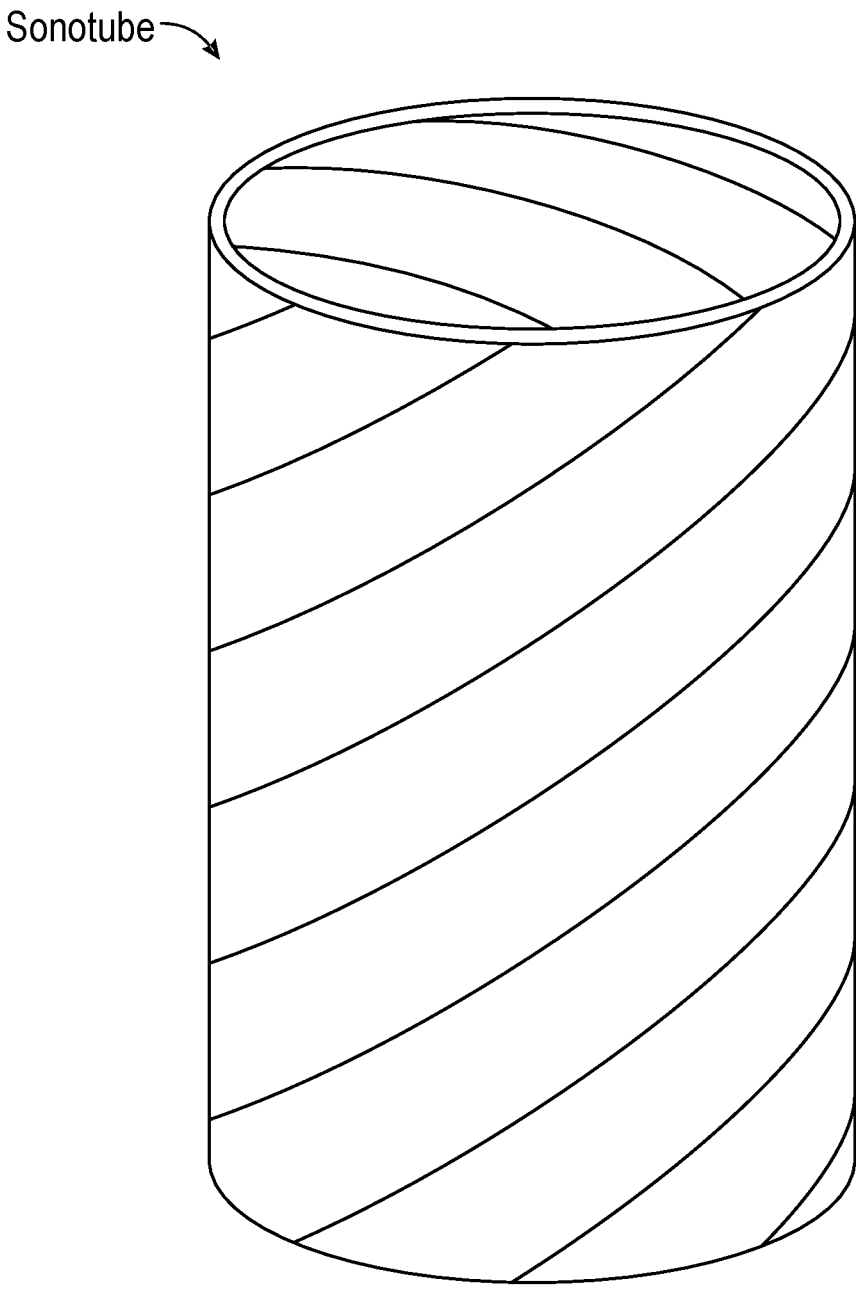
FIGURE 1 (Prior Art)
FIG. 1 shows an example of existing Sonotube concrete forms that are only manufactured in specific sizes that are not adjustable.

In construction of buildings and bridges, there is often a need to build circular columns. The forming of these columns is not very easy and can be expensive and time-consuming. The current construction practice globally depends on using cardboard tubes that are available in a few sizes. One of the most popular brands in the U.S. is Sonotube®, as shown in FIG. 1, which virtually has a monopoly in the industry. These cardboard tubes are often referred to as "Sonotube®" even if they are manufactured by a different manufacturer. These non-adjustable and non-reusable tubes come in various thicknesses depending on their diameter to ensure a sturdy formwork. Once the concrete is cast and cured, the formwork (i.e. Sonotube®) is cut and removed. There are several shortcomings with the use of Sonotubes® as listed below:

1. Sonotubes® only come in certain fixed sizes; for example there is no 11.25 inch diameter Sonotube®; the closest sizes are 10 and 12 inch diameter tubes.
2. Contractors must order the Sonotube® to the desired diameter and stock pile them for each project.
3. Sonotubes® are available only in cylindrical shapes.
4. Sonotubes® are bulky and storing and shipping them becomes expensive.
5. Once Sonotubes® arrive on the job site, they require a large storage area protected from rain and snow for Sonotubes® not to become damaged.
6. Sonotubes® can be used only once, which add to the cost of the project.

In response to these shortcomings new methods and new articles of manufacture are disclosed for making concrete formworks.

The disclosed method requires using flat or pre-curled, strong, durable and flexible sheets of any materials. One such ideal material is PileMedic® PLG60.60 that is sold by QuakeWrap, Inc., Tucson, Ariz. (www.PileMedic.com). This example product is manufactured from a biaxial glass fabric that is saturated with resin and is cured under pressure and heat. The result is a sheet that is, for example, 4 to 5 feet wide and several hundred feet long. The thickness of the sheet is only about 0.026 inch, making the sheet very light and flexible so it can be coiled around a 4-5 inch diameter core. The sheet may also be manufactured in a curled form. Therefore a 4-ft wide×300-ft long piece of this laminate sheet can be coiled and fit in a box that is merely about 14×14 inch in cross section and about 50 inches long. This compact packaging is one of the advantages of the new system. Other plastic sheets such as HDPE, PVC, vinyl, rubber, etc. can also be used for the same applications.

In some embodiments the laminate sheets are very strong and very durable since they do not absorb water. So, they can be used numerous times. A further property of these laminates is their smooth surface which serves two functions. First, it provides a smooth finished surface for the concrete column that is constructed using this technique. Secondly, the smooth surface prevents bonding of concrete to the form, so the form can be easily removed after each use and be reused. Neither one of these attributes is true about the Sonotubes®.

Figure 2:
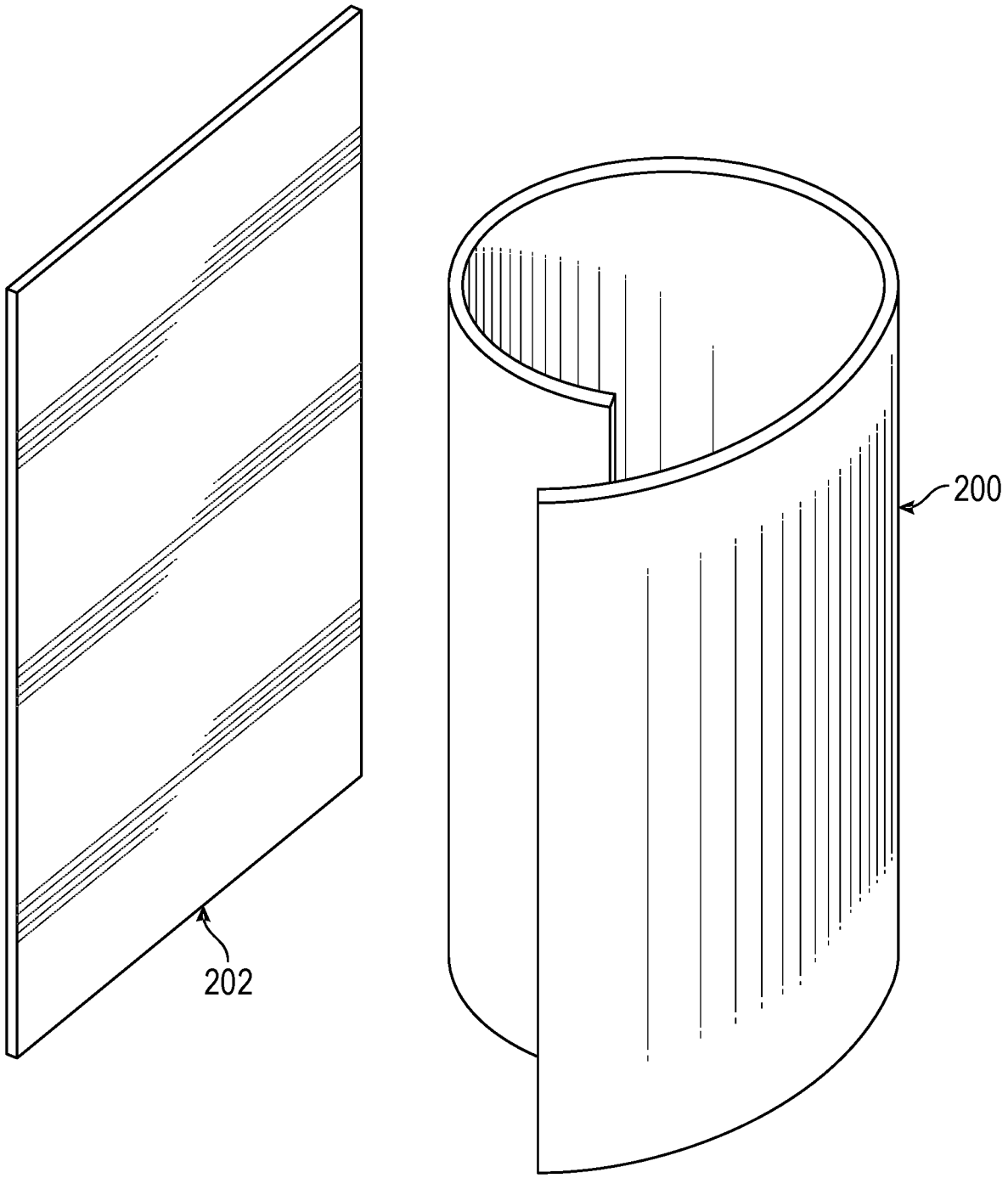
FIG. 2 illustrates an example curled or wrapped laminate to be used as a circular-column concrete form.

The assembling of a formwork according to this disclosure in the field is very easy. For example, if it is desirable to build a 5 foot tall and 11 inch diameter column, a 104 inch long segment is cut in the field from a 5-foot width laminate or from a larger width laminate. This will provide for a 3-ply or 3-layer formwork. This piece of laminate is wrapped around itself 3 times to create a tube or a jacket that is 11 inches in diameter and 5-ft tall. Even without any adhesive, the friction between the layers of the laminate prevents it from unraveling and opening up. FIG. 2 illustrates an example curled laminate 200 and a flat laminate 202 to be used as a circular-column concrete form. Optionally, one or a few pieces of string or tie wire or shrank-wrap can be wrapped around the tube/jacket to maintain its diameter. In some cases, just a small piece of adhesive tape such as duct tape is sufficient to hold and secure the end of the laminate in place and help to prevent its unravelling.

It is important to note that the laminate 200 is pre-curled by the manufacturer. One advantage of a pre-curled laminate is its ease of installation and its ability to keep its installed shape without, for example, the need to have a rope tied around it or a frame placed within it, while one of the advantages of a flat fabricated laminate is the ease of storage and transportation. In other embodiments the frames may be totally removed after formation of the formwork. The formwork may also be externally braced to make sure it remains in a plumb position while concrete is being placed. In some embodiments, for example, a reinforcing case of rebars may be utilized as a skeleton around which the laminate sheets are wrapped.

When the concrete is poured inside the formwork the hydrostatic pressure of the fresh concrete pushes the formwork radially and outwardly; however, the friction between multiple layers of the laminate is sufficient to prevent unraveling of the formwork. The adhesive tape, Velcro, strings, or tie wire or shrink-wrap may also help to keep the formwork in its original shape while the concrete cures. When the concrete is set, which may only take a day, the laminate sheet can be removed and wiped cleaned. The laminate is now ready to be used many more times.

For taller columns, either wider laminates (wider than 5-ft) can be used or the 5-ft wide laminates can be longitudinally overlapped by a couple of inches to create an approximately 10-ft tall formwork. In other embodiments adhesive tape, such as duct tape, may be placed over the curved abutting line of the two adjacent stacked forms. In various embodiments laminate bands may be wrapped as many times as necessary to achieve the desired height.

Figure 3:
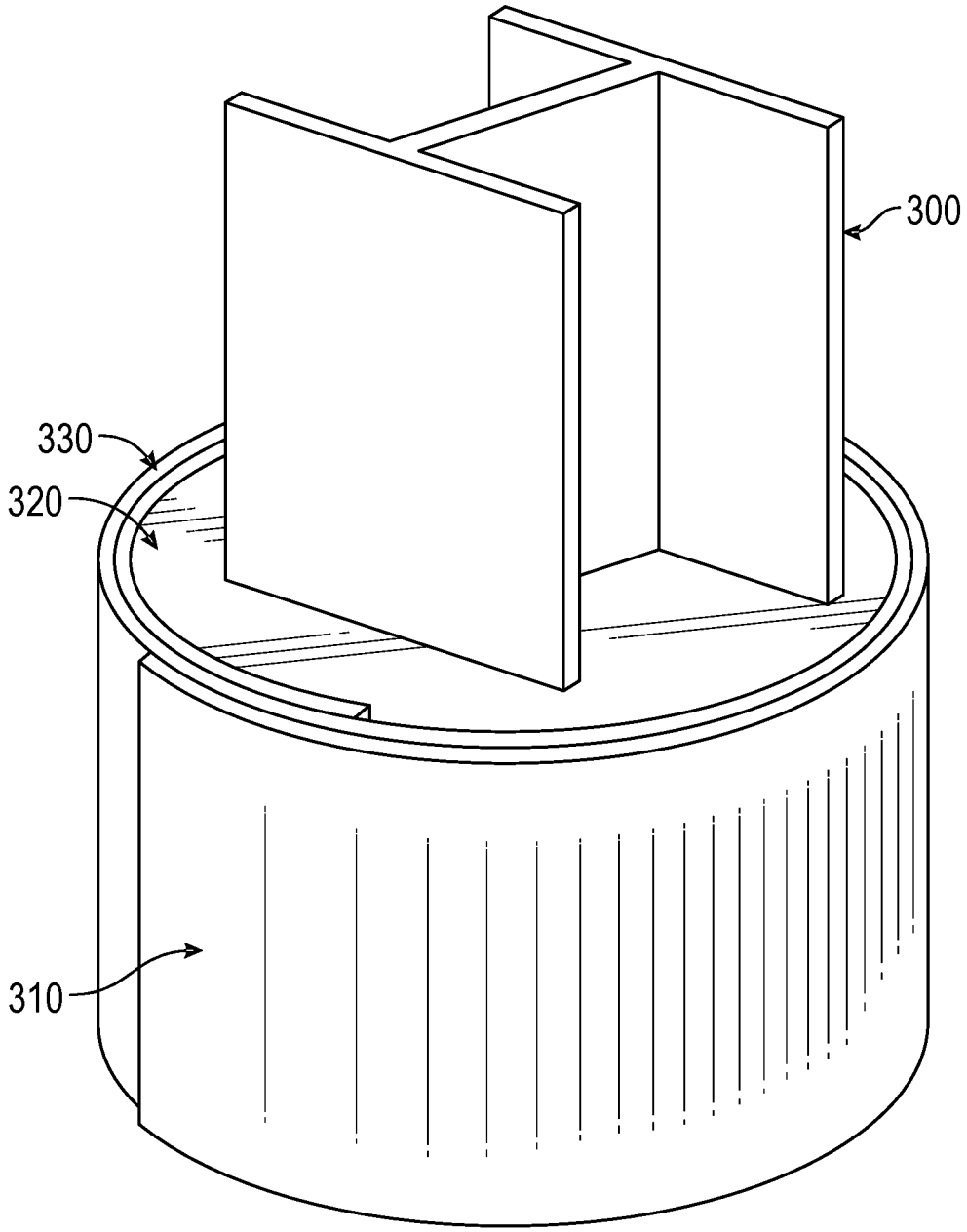
FIG. 3 illustrates an exemplary repair method for a corroded steel H-pile by encasing the steel H-pile in a cylindrical concrete encasement according to the present disclosure.

FIG. 3 shows an exemplary repair method of a corroded steel H-pile 300 by encasing it in a cylindrical concrete encasement 320 according to this disclosure. In this example only the bottom 2-feet of the pile 300 needs repair. For this repair a 12-feet by ×2-feet laminate 330 is cut; long enough to be wrapped about 2.5 times around the H-pile 300. The laminate 330 is wrapped around the steel H-pile 300 and once the desired size (i.e. diameter) is obtained, a few ratchet straps may be wrapped around the laminate to make sure it maintains its size. In FIG. 3 the ratchet straps are not shown. Subsequently, the annular space 320 between the laminate shell 310 and the H-pile 300 is filled with concrete or grout. Once the concrete or grout is cured, the laminate shell 310 can be unwrapped and removed and it can be wiped clean to be reused many more times. In various embodiments the laminate 310 may be wrapped as many times around itself as it cannot be unwrapped despite the internal pressures caused by the fresh concrete. This is an important advantage of the disclosed apparatus and methods because in many situations, such as reinforcement of columns under water, it is not allowed to use resin or even stainless steel bolts, for environmental considerations.

Figure 4:
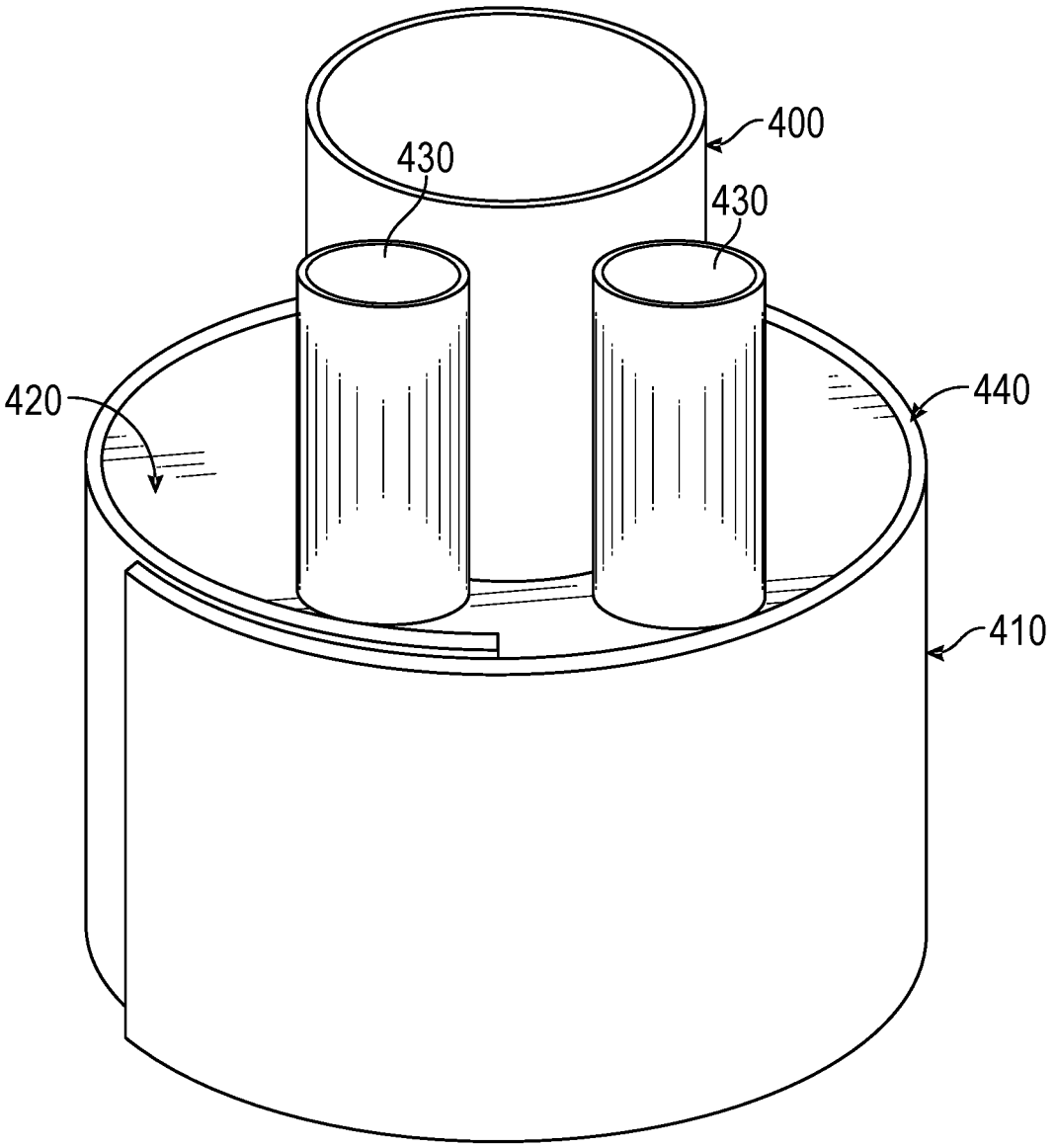
FIG. 4 illustrates an exemplary method for enlarging a square or a rectangular column.

A further advantage of this method is that it is able to construct a cylindrical or a non-cylindrical formwork/form around an existing column. For example, as in FIG. 4, it may be desirable to increase the thickness (i.e. diameter) of a 14-inch diameter column by 4 inches. This task would be impossible to achieve by Sonotubes® because a Sonotube® cannot be slipped over an existing column whose two ends are attached to the floor slab and the celling. With the proposed method, for example, a few spacers such as 2-inch diameter PVC pipes 430 may be longitudinally taped to the existing column 400. Then the laminate sheet 440, which is cut to desired length, is wrapped around column 400 and over tubes 430. The result is an almost cylindrical shell that is 4 inches wider than the original 14-inch diameter column. Once the concrete is placed in the formwork before it is cured, if desired, the spacer tubes 430 (i.e. PVC pipes) can be gradually pulled out of the formwork before the concrete is cured. Construction of a formwork/form around an existing column may be also achieved without the use of spacers between the column and the laminate sheet.

Figure 5:
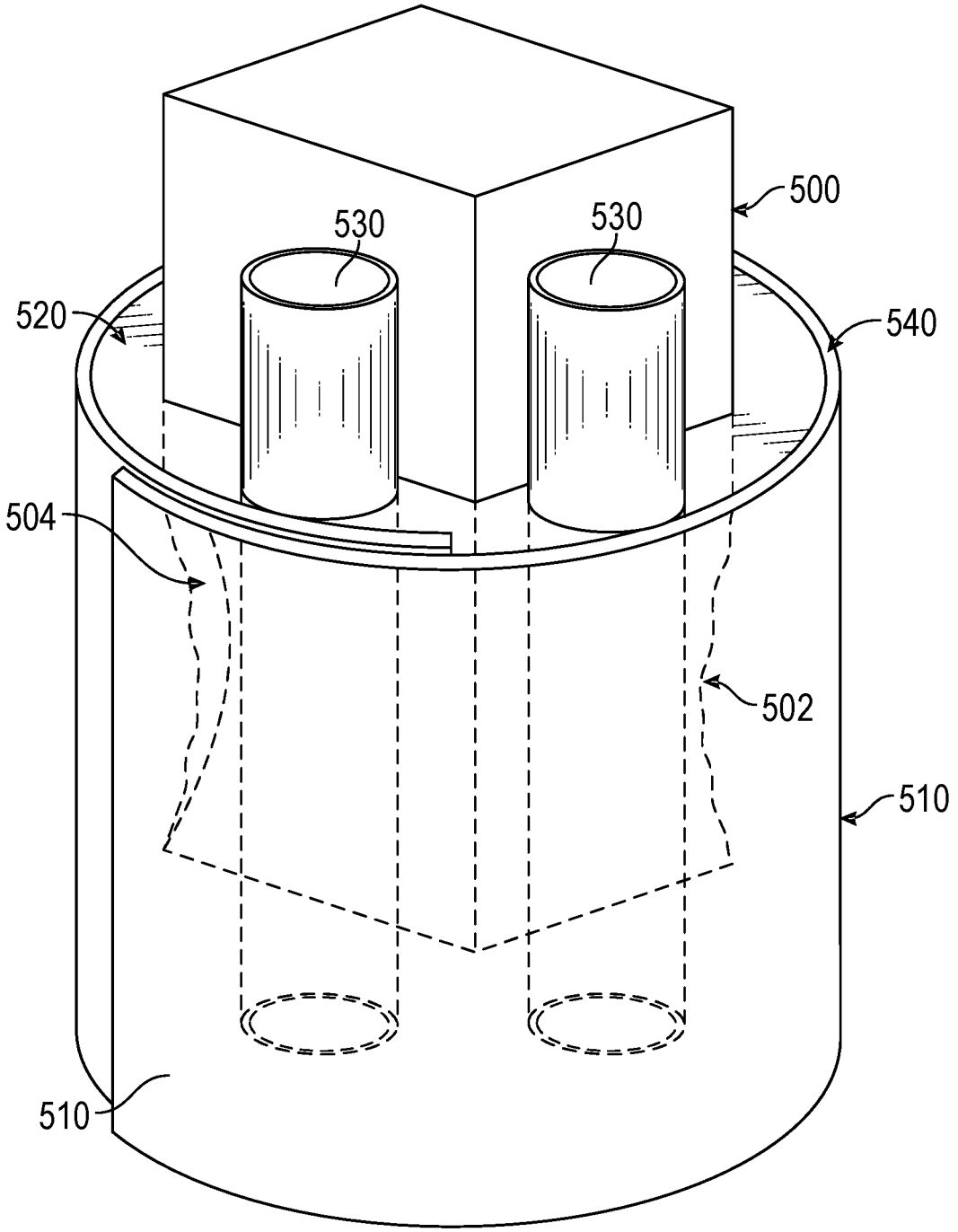
FIG. 5 shows another repairing method of a damaged column.

FIG. 5 illustrates another application of the proposed methods for repair of columns. As shown in FIG. 5, the far corners 502 of column 500 is damaged by corrosion and spalled. Therefore, a form has to be made around the column and filled with concrete or grout. After the column 500 is washed and cleaned, optional spacers 530 are positioned adjacent to the surface of the column 500, for example at half-way points between corners. Then the laminate 540 is wrapped around the column 500, for example about two or three times, to form shell 510.

It is important to mention that the more the layers of the laminate 540, the less the need for using any kinds of strap, rope, or tape around the framework since the friction between the layers will not permit the laminate 540 to unwrap, especially if the laminate 540 is pre-curled. Even if an insignificant strap, rope, or tape is used around the wrapped laminate, it is merely for creating an initial friction between the layers of the laminate which increases by the internal pressures of the fresh concrete. The tension in the strap, rope, or tape is not the reason for creating resistance against unwrapping. Almost all the resistance against unwrapping is caused by the friction between the layers of the laminate. In some embodiments the inner surface of the laminate 540 may be slightly wetted to increase the friction between the layers. Concrete is then placed in the annular space 520 between the shell (i.e. formwork) and the column 500. Once the concrete is cured, the laminate 540 is unwrapped and removed or peeled off. The laminate 540 can be wiped clean and used over and over again. In some embodiments the outer surface of the laminate 540 may be slightly wetted to add to the friction between the laminate layers. In various embodiments surface(s) of the laminate sheet may not be very smooth by design to increase the friction between the laminate layers.

In various applications and embodiments the friction between the layers of the laminate 540 is nearly sufficient to hold the formwork/shell 510 together even when any filler material is poured in the annular space between the shell (i.e. formwork) and the column. Actually the pressure created by the filler material on the shell increases the pressure between the shell layers which in turn increases the friction between the shell layers. And in many cases, just a small piece of duct tape or the like is sufficient to hold the end of the laminate in place to prevent its unravelling. The use of the ratchet straps is often an "overkill".

In some embodiments, shell 510 can be left in place in which case the laminate 540 can serve as a reinforcing or a protective "skin" element for the newly cast column. The laminate 540 will also prevent moisture ingress and thus delay or stop corrosion of the column inside the concrete casting.

A further advantage of the disclosed system and method is in repair of columns that have a tapering geometry and/or a non-circular cross-section. These are very commonly used as cell phone towers or utility poles. If one wishes to increase the diameter of a tapering tube by 2 inches, for example, the present disclosed methods may be adopted. In this case for example, six 1-inch diameter PVC pipes are tied around the tube at 60 degrees apart. Then the laminate sheet is wrapped around these PVC pipes; this results in a tapering formwork that is radially offset by 1 inch from the original column (or tube) along the whole length. Both the original pole and the new casting will have the same exact taper.

This disclosure also relates to the repair and strengthening of columns and piles that may be submerged in water. Such structures are subjected to loads such as those induced by gravity, traffic, earthquakes, blast and explosion, strong winds, flow-induced forces from water and the like. These structures often corrode and require repair and reinforcement.

One method for reinforcing a weakened column or pile is to encase it in a slightly larger plastic or FRP and fill the annular space with filler materials such as resin or grout. Fiber Reinforced Polymer (FRP) is made of fibers such as glass, carbon, basalt, aramid and the like saturated with a resin such as epoxy, polyester, vinyl ester and the like and then allowed to cure. If such jackets are installed to include a continuous wrap around the column in the hoop direction, the resulting confining pressure on the pile or column adds significant strength to the structure. Strengthening a pipe from the outside is very similar to reinforcing a concrete column, for example, as described below.

Figure 6A:
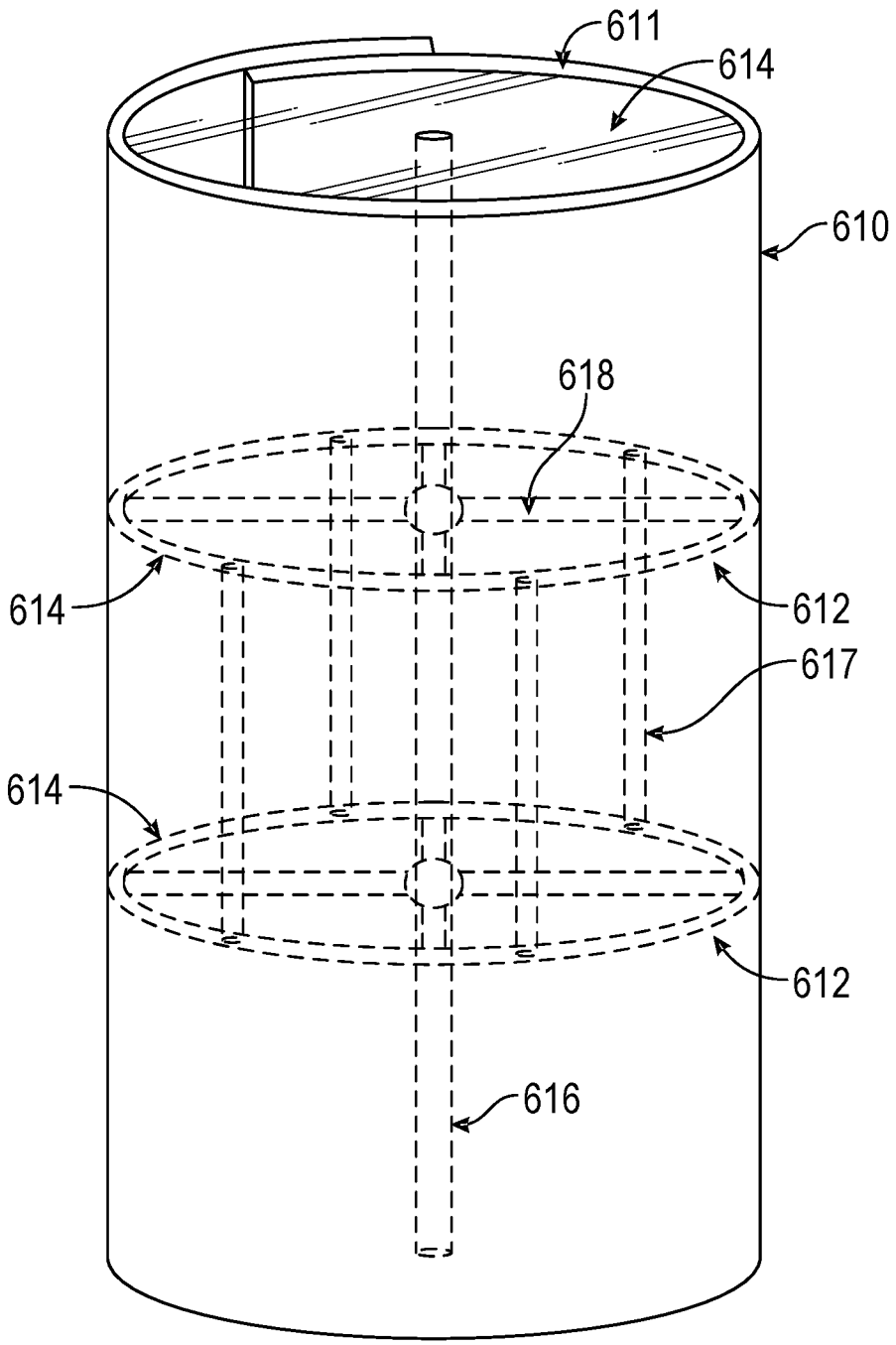
FIGS. 6A and 6B show exemplary methods, which use Spiral-Wound Bands (SWB) or non-SWBs for construction of columns/pillars and repair of pipelines.
Figure 6B:
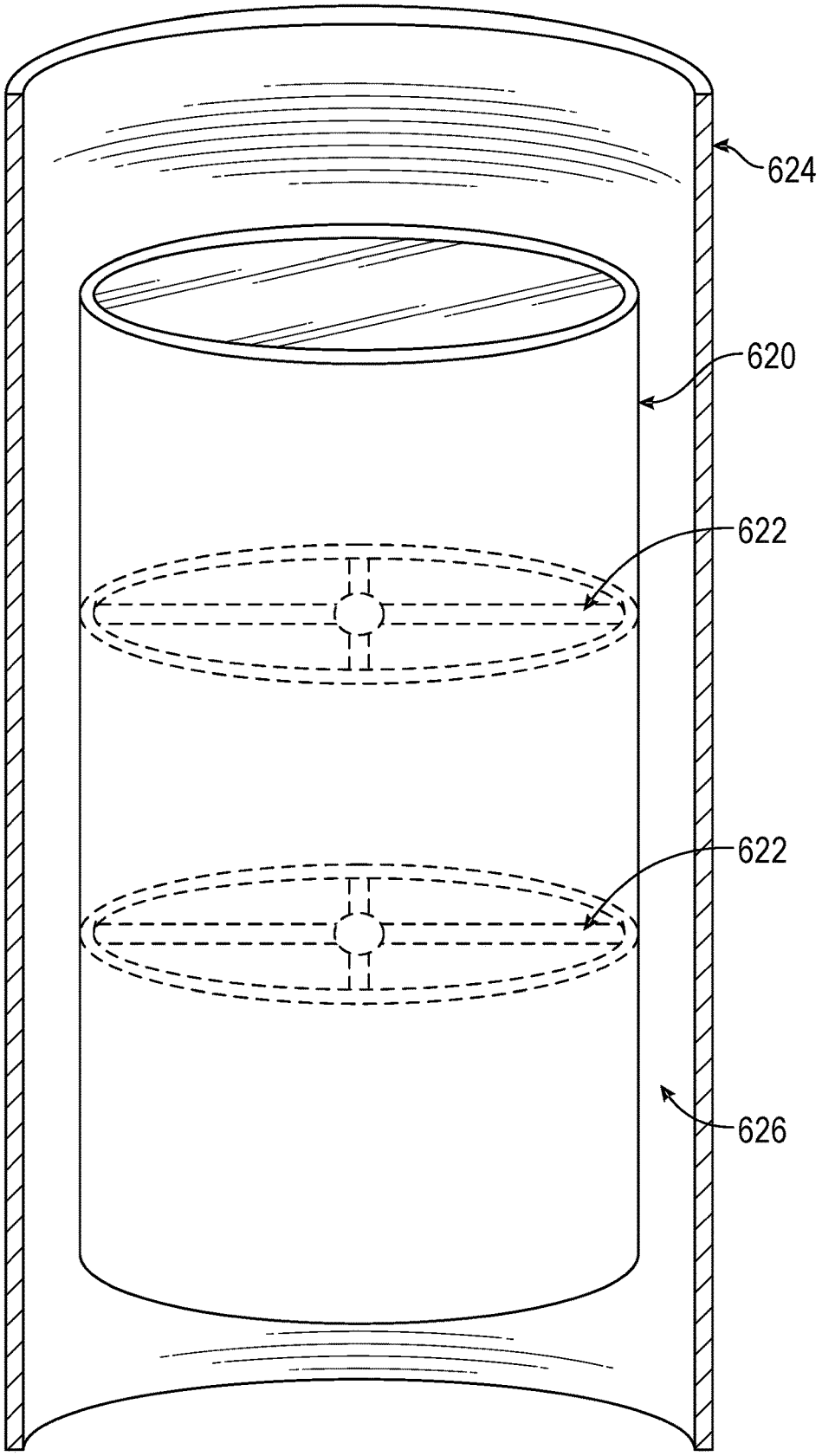

FIGS. 6A and 6B show exemplary methods, which use Spiral-Wound Bands (SWB) and non-SWBs for construction of columns/pillars and repair of pipelines (Spiral-Wound is not shown). FIG. 6A illustrates a method and an exemplary apparatus for constructing a shield 610 around a hollow frame for constructing a column, wherein the shield 610 is formed with a desired internal diameter. In FIG. 6A, shield 610 is formed by wrapping laminate 611 around sample disks 612 or merely around hoops 614, which in this embodiment are integral parts of disks 612 but may be used separately. In some embodiments a strap of any kind may be also wrapped around shield 610 to create initial friction between the layers of the laminate 611; however, the more the laminate 611 is wrapped around itself, the less is it needs to have any kind of constraining members around shield 610. In FIG. 6A, each of the disks 612 has four ribs 618 and one hoop member 614. In various embodiments the hoops 614 may be used inside the shield 610 without ribs 618. In some embodiments disks 612 may be attached to each other via a central shaft 616 and/or hoops 614 may be attached to each other via perimeter elements 617. In other embodiments disks 612 may only include hoops 614.

Hoops 614 are mainly used as guides to wrap the sheets 611 around them and ensure a uniform diameter form. These disks 612 may have openings to allow passage of concrete through them. These disks 612, as will be described in more details, may also contain holes for placement of longitudinal steel reinforcing bars that are often used in construction of columns. The disks 612 or hoops 614 can be secured together at a desired distance along the height of the column to create a skeleton or a frame around which the laminate sheets 611 are wrapped.

In yet other embodiments, for ease of transportation, each of the hoops 614 may initially be a straight strap of material to be curved on site to produce a hoop of any desired diameter. The Individual hoops 614 may be configured to be opened after each use and revert to reusable straight straps. As is obvious to anyone skilled in the art, each strap provides several choices of desired diameters. To have a conical column, each neighboring hoop 614 may be adjusted to be slightly larger or smaller.

FIG. 6B shows a repair method for a damaged or weak pipe 624. In this embodiment shell 620 is constructed in the same manner as has been described above; however, instead of encircling a structure, the shell 620 is positioned inside the pipe 624 at a radial distance 626 from the pipe wall. Later, between the shell 620 and the pipe 624 is filled with desired materials such as concrete, at which time the shell 620 and frame 622 may be removed or be left in place. In some embodiments reinforcing elements such as steel or FRP rebars can also be positioned in the annular space formed between the shell 620 and the host pipe 624 to further strengthen the pipe 624.

Figure 6C:
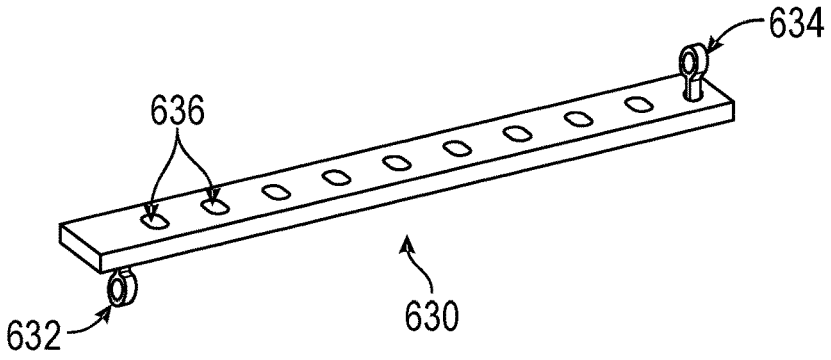
FIG. 6C illustrates an example strap which can be looped into different diameter rings and may be used as described with respect to FIG. 6A.

FIG. 6C illustrates an example strap 630 which can be looped into different size rings and may be used as described above. In this example after encircling strap 634, locking protrusions 634 and 632 will tightly enter two of the holes 636 and form a ring. Strap 630 may have multiple rows of holes 636 and of locking protrusions 632 and 634. In some embodiments these straps may be cut to a desired calculated length before making the hoops.

Figure 6D:
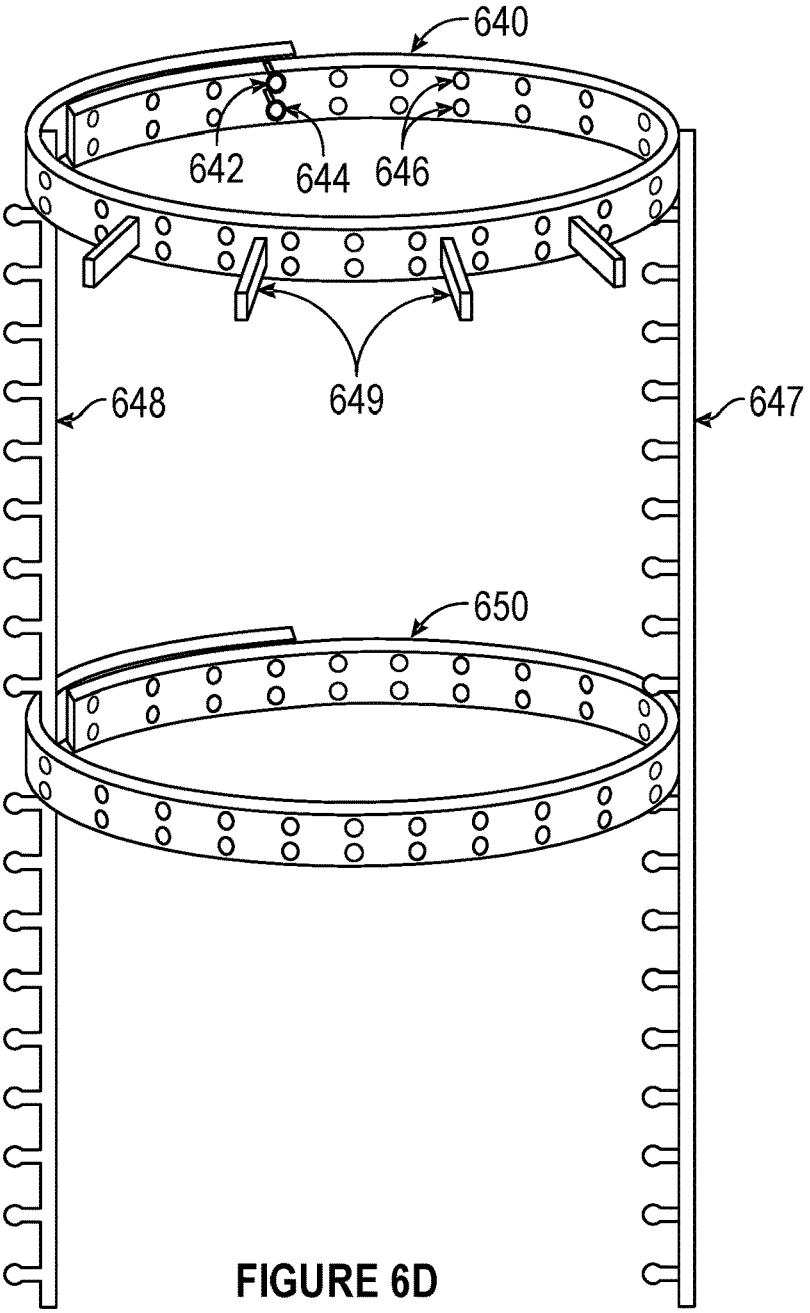
FIG. 6D shows an example strap for making a ring with two rows of holes and two locking protrusions at each end of the strap and also illustrates peripheral members which may be used to construct frames of different diameters and heights, according to another embodiment of the present invention.

FIG. 6D shows an example looped straps 640 and 650 with two rows of holes 646 and two locking protrusions 642 and 644 at each end of straps 640 and 650. In this embodiment the perimeter elements 647 and 648 tightly engage the hoops/rings from inside or outside of the rings, which are formed using straps 640 and 650. The combination of hoops 640 and 650 and perimeter elements 647 and 648 form a frame/skeleton for wrapping desired laminates around the frame and constructing a shell that subsequently holds the poured concrete.

Straps 640 and 650 and perimeter elements 647 and 648 may be made from semi-flexible, semi-rigid, and/or rigid materials as desired, such as plastic. In practice, shells may be constructed while frames are horizontally laid on the ground and be erected after the formation of the shells. One of the advantages of making the rings with open and uncoiled straps is that even for repairing a damaged column that is located between a floor and a ceiling, unlike the Sonotube®, the frame can be easily formed around the column and later be removed along with the shell.

In various embodiments straps 640 and 650 may also have protrusions 649 to make sure that hoops 640 and 650 and perimeter elements 647 and 648 remain concealed and fully encased in the cured concrete and not exposed to the outside of the structure/column.

Figure 6E:
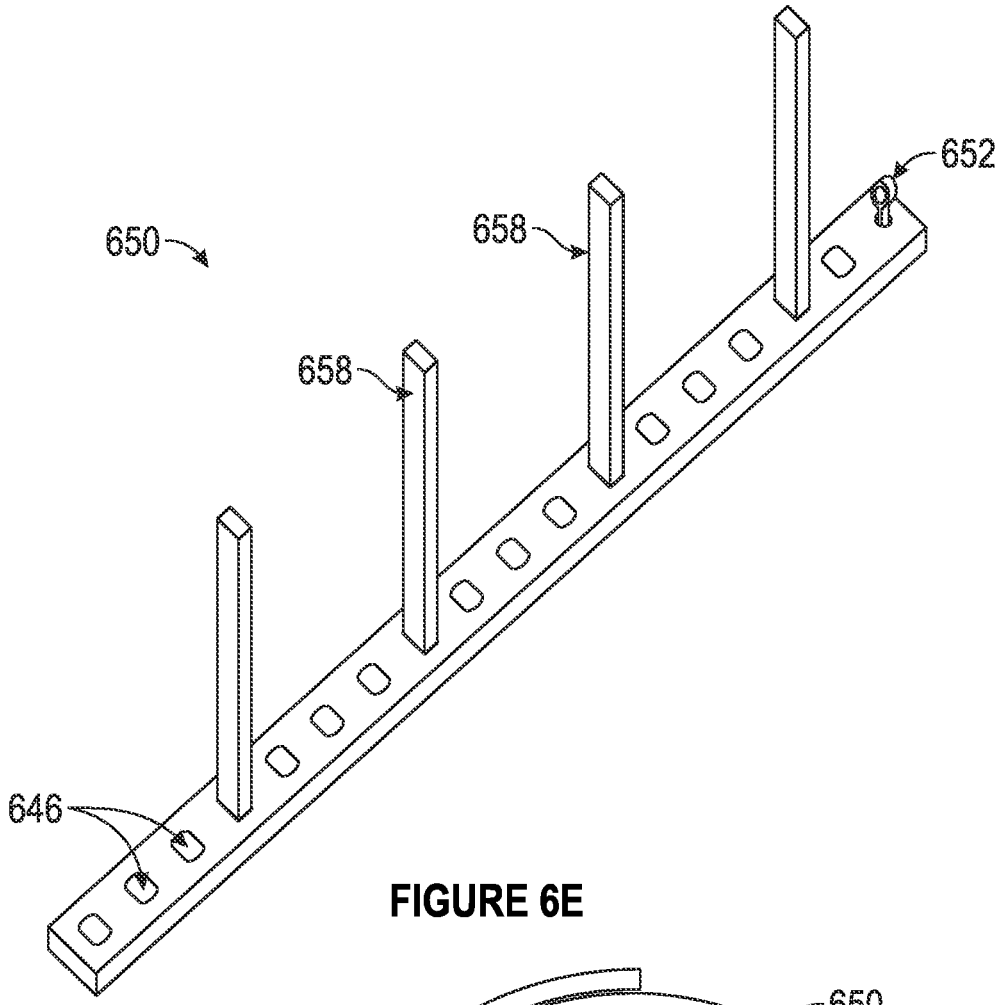
FIG. 6E shows an example strap for making a ring with two rows of holes and two locking protrusions at each end of the strap, where the strap also includes long adjustable-length spacers, and peripheral members which may be used to construct frames of different diameters and heights at a desired distance around an existing column, according to another embodiment of the present invention.
Figure 6F:
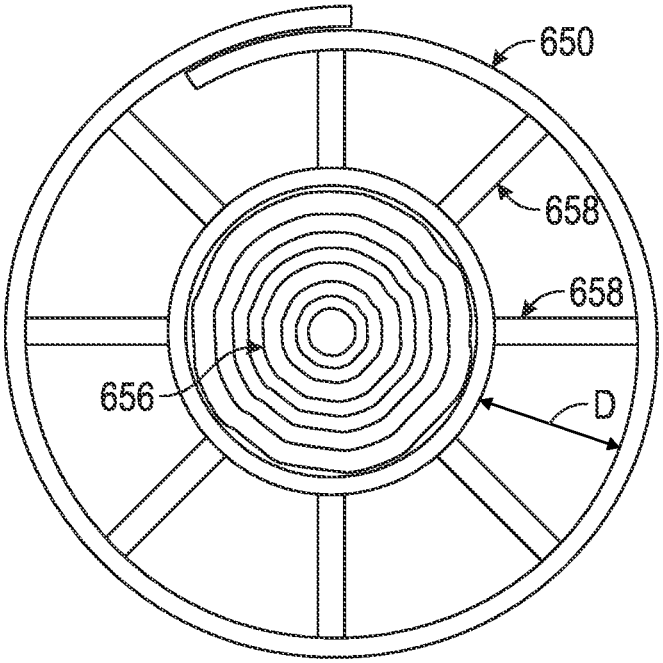
FIGS. 6F and 6G shows an example strap FIG. 6E, used in different ways around an existing column.

FIG. 6E shows an example strap 650 with one or more rows of holes 646 and locking protrusion 652, for each row, at each end of strap 650. In this embodiment the perimeter elements 647, shown in FIG. 6D, may or may not be used. In various embodiments straps 650 may also include spacer members 658 which may be manufactured as a part of strap 650 or be added to the strap 650 by inserting one end of the spacer members 658 into some holes 646. These spacer members 658 may be left intact if merely a formwork/shield/shell is desired for construction of a new column or, as shown in FIG. 6F, the strap 650 and the spacer members 658 may be cut and trimmed to desired lengths to help the hoop stay, at any desired distance "D," around an existing column 656. After a few of these hoops are secured around a column, with or without perimeter elements 647, pre-curled or plane laminates are wrapped around column 656 at distance "D" at least as many times as required not to unwrap due to internal pressures caused by the uncured concrete. Even when the column 656 is round, the strap 650 and the spacer members 658 may be cut and trimmed such that the hoop around column 656 takes different shapes, for example ellipse or the like.

Figure 6G:
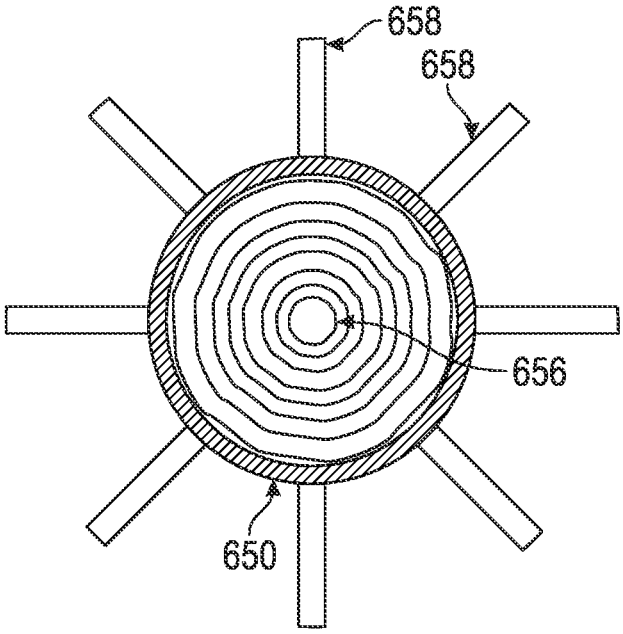

In some embodiments, such as in FIG. 6G, the strap 650 is coiled in the reverse direction such that the spacer members 658 point outwards and away from the column 656. In this case, it may be preferable to have the free ends of the spacers 658 relatively small and pointed such that after the casting of concrete and removal of the formwork, little if any portions of the strap 650 is visible.

Figure 6H:
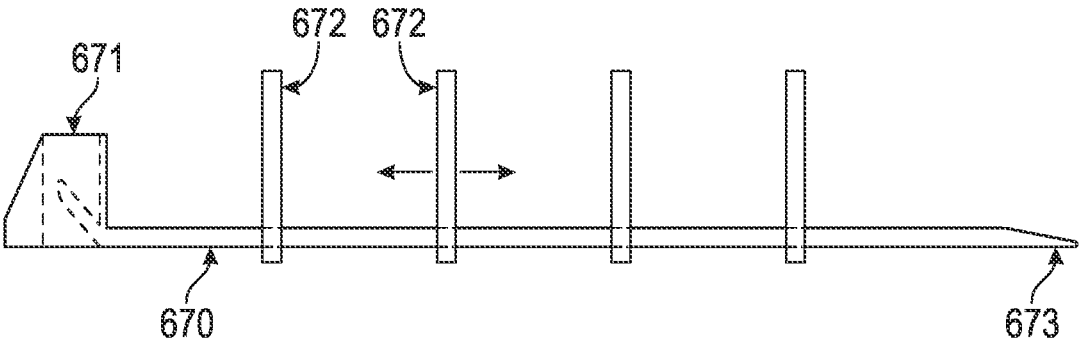
FIG. 6H shows an example strap made of tie-wrap along with spacers that can slide over the tie-wrap.

FIG. 6H shows an example strap made of a tie-wrap 670 which includes a locking head 671 and a tail end 673 along with spacers 672 that can slide over the tie-wrap 670. This tie-wrap 670 and its spacers 672 may be mounted on any existing structure in the same manner as illustrated in FIG. 6E3.

Please note that the roughness of the surface(s) of the laminates can be designed to have any coefficient of friction as desired, without bonding to the inside concrete.

In recent years a technique has been developed for repair of pipelines that uses Spiral-Wound Bands (SWB). SWBs are typically made of plastics such as HDPE, PVC and the like that can be easily molded to any shape. While a SWB is being wrapped, the edges of the adjacent turns are overlapped and are interlocked together by a male and a female strip/band that are manufactured as a part of the SWB. This locking mechanism is very similar to the mechanism of Ziploc® plastic bags.

Figure 7A:
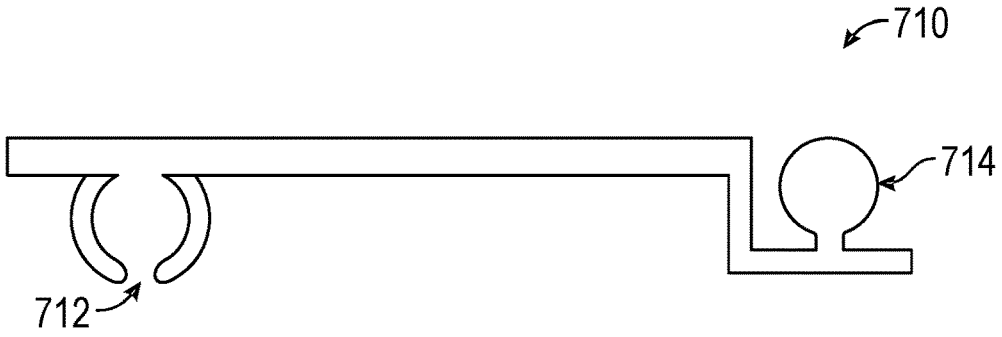
FIGS. 7A, 7B, 7C, and 7D show some of the many possible profile shapes for SWBs.
Figure 7B:
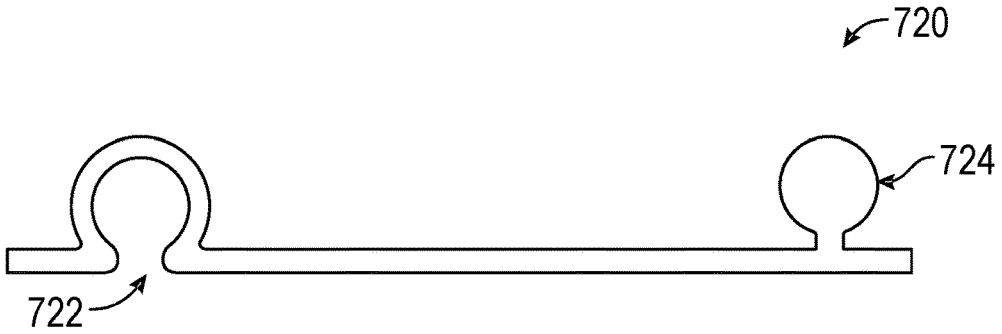
Figure 7C:
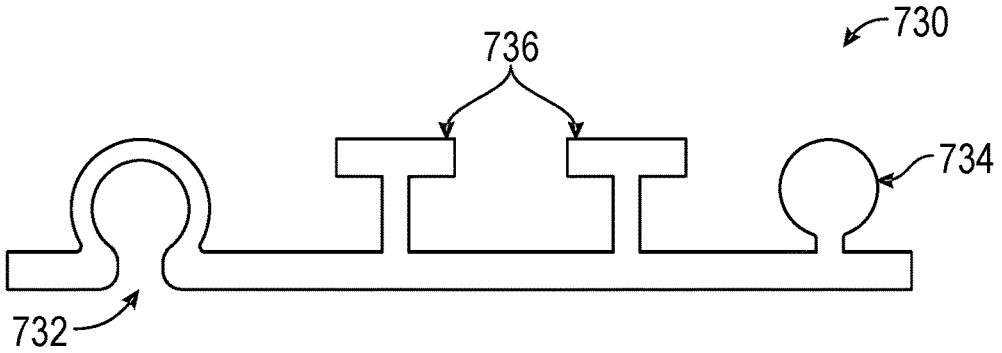
Figure 7D:
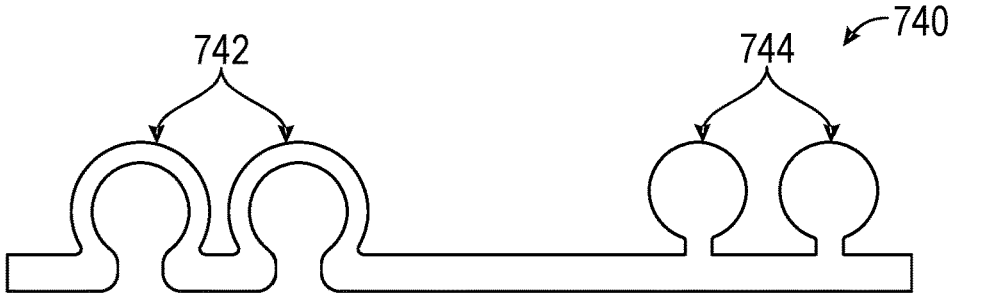

FIG. 7A shows one of the many possible profile shapes for SWBs that produces a smooth surface inside of the wrapped shell. This profile 710 may be used to construct pipes using the disks/hoops introduces in FIGS. 6A and 6B. The band also includes a protruding male locking part 714 that will be inserted to a similarly shaped female locking part 712. In a spiral winding, part 714 of one band will be inserted into part 712 of the adjacent winding, and this will bond or lock each band to its neighboring band. If desired a lubricant or a sealant or adhesive can be placed in cavity 712 before the male part 714 is inserted FIG. 7B shows another possible profile 720 of the SWB which does not produce a smooth surface inside of the wrapped shell and may be preferable if the resulted shell is left in place after the pouring of the filler material between the shell and the column. This profile 720 includes a protruding male locking part 724 that will be inserted into a similarly shaped female locking part 722. FIG. 7C illustrates yet another possible profile 730 of the SWB which does not produce a smooth surface inside of the wrapped shell and with its T-shape ridges 736 may be even more preferable if the resulted shell is left in place after the pouring of the filler material between the shell and a pipe, for example. This profile 730 includes a protruding male locking part 734 that will be inserted into a similarly shaped female locking part 732. FIG. 7D shows yet another possible profile 740 of the SWB which has two interlocking male strips 744 and two interlocking female 742 at its edges for stronger bonding of the wrapped loops.

It is important to note that the above described methods of repair or construction may be also performed by spirally wound laminate bands instead of non-spirally wound laminate sheets.

In some embodiments the exterior surface of the shell or jacket can be coated with a coating that protects the jacket against ultraviolet rays. In other embodiments coatings of various texture and color can be applied to the exterior of the jacket to achieve the desired architectural appearance.

In this specification a method, a system, and an article of manufacture are disclosed for reinforcing various structures, such as pipes, ducts, vessels, tanks, silos, beams, columns, walls, slabs and the like, constructed from various materials including, but not limited to steel, concrete, masonry, wood, plastics, and the like, where the article of manufacture is reusable. The same or very similar article of manufacture may also be used to temporarily or permanently build a pipe of any desired diameter In some embodiments the wrappers are in the shape of long bands of reusable materials and are wound helically around the workpiece and in other embodiments the wrappers are large sheets of bendable, flexible, or semi-rigid materials and are wrapped non-helically around the workpiece. Those skilled in the art recognize that additional reinforcement material such as still rebars or carbon strips may be placed inside the spaces between the wrapped materials and the workpieces.

In various embodiments, a layer of 3D fabric is impregnated or saturated with a resin and is used as a sheet of laminate material. A 3D fabric is a special type of fabric made, for example, with glass, carbon, or Kevlar reinforcing fibers. The 3D fabric is woven as two X-Y fabric layers that are connected with short fibers of glass, carbon or Kevlar fibers, substantially in Z direction. (X, Y, and Z create a Cartesian coordinate system.) During application of 3D fabrics, both layers of the fabric can be saturated with a resin such as epoxy, polyester or vinyl ester at the same time. During the curing process, the short fibers in Z-Direction will rise causing further separation between the two layers of the fabric to form a 3D structure—a thick sheet of laminate. This process results in a cured three-dimensional structure with a certain thickness and stiffness that is more than the thickness and stiffness of the 3D fabric before the application of the resin.

Changes can be made to the claimed invention in light of the above Detailed Description. While the above description details certain embodiments of the invention and describes the best mode contemplated, no matter how detailed the above appears in text, the claimed invention can be practiced in many ways. Details of the system may vary considerably in its implementation details, while still being encompassed by the claimed invention disclosed herein.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the claimed invention to the specific embodiments disclosed in the specification, unless the above Detailed Description section explicitly defines such terms. Accordingly, the actual scope of the claimed invention encompasses not only the disclosed embodiments, but also all equivalent ways of practicing or implementing the claimed invention.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B," and also the phrase "A and/or B" will be understood to include the possibilities of "A" or "B" or "A and B."

The above specification, examples, and data provide a complete description of the manufacture and use of the composition of the invention. Since many embodiments of the invention can be made without departing from the spirit and scope of the invention, the invention resides in the claims hereinafter appended. It is further understood that this disclosure is not limited to the disclosed embodiments, but is intended to cover various arrangements included within the spirit and scope of the broadest interpretation so as to encompass all such modifications and equivalent arrangements.

While the present disclosure has been described in connection with what is considered the most practical and preferred embodiment, it is understood that this disclosure is not limited to the disclosed embodiments, but is intended to cover various arrangements included within the spirit and scope of the broadest interpretation so as to encompass all such modifications and equivalent arrangements.

I claim:

1. A method of constructing a formwork for reinforcing and/or repairing an existing structure using reusable materials, the method comprising:

fastening an adjustable-length strap around the structure to form a hoop around the structure by bending the adjustable-length strap and joining both ends of the strap together;

attaching adjustable-length spacer protrusions to the adjustable-length strap, wherein the spacer protrusions radially point outwardly and away from the structure;

wrapping a flexible or a semi rigid or a semi flexible flat sheet of material or a pre-curled sheet of material around the structure to also enclose the spacer protrusions and create a shell such that there remains a gap between the shell and the structure;

pouring reinforcement material into the gap between the structure and the shell, wherein the sheet materials is wrapped at least as many times as required to keep the shell from unwrapping in spite of the internal pressures caused by the reinforcement material and wherein a friction between multiple layers of the wrapped sheets of material is sufficient to prevent unraveling of the formwork; and leaving the shell in place or unwrapping the shell.

2. The method of claim 1, wherein the straps have at least one row of holes in their longitudinal direction and at least one locking protrusion at one end that is configured to tightly engage any of the holes.

3. The method of claim 1, wherein the straps have multiple adjustable-length spacer protrusions which are designed to be trimmed and keep the wrapping at a desired distance from an inner structural member.

4. The method of claim 1, wherein the spacer protrusions are rods inserted to at least some of the holes of the strap.

5. The method of claim 1, wherein surfaces of flat or pre-curled sheet of material have predetermined coefficients of friction.

6. The method of claim 1, wherein the straps are tie-wraps and multiple spacer protrusions slide over the tie-wraps to keep a wrapped sheet at a desired distance from the structure.

7. The method of claim 1, wherein the straps and the spacer protrusions are made of plastic, steel, or FRP rebars.

8. The method of claim 1, wherein the adjustable-length spacer protrusions are designed to be trimmed and keep a wrapped sheet at a desired distance from the structure.

9. The method of claim 1, wherein the spacer protrusions are rods inserted to all of the holes of the strap.

10. A method of reinforcing and/or repairing a structure using reusable materials, the method comprising:

fastening an adjustable-length strap around the structure to form a hoop, by bending the adjustable-length strap and joining both ends of the strap together, wherein the strap has integrated adjustable-length spacer protrusions on one side of the strap and wherein the strap is either tied such that the strap touches the structure while the adjustable-length spacer protrusions radially point outwardly and away from the structure or such that the strap stays at a distance from the structure and the spacer protrusions point inwardly towards the structure;

wrapping a flexible or a semi rigid or a semi flexible flat sheet of material or a pre-curled sheet of material around the structure to also enclose the hoop and the spacer protrusions and create a shell such that there remains a gap between the shell and the structure; and pouring reinforcement material into the gap between the structure and the shell, wherein the sheet materials is wrapped at least as many times as required to keep the shell from unwrapping in spite of the internal pressures caused by the reinforcement material and wherein a friction between multiple layers of the wrapped sheets of material is sufficient to prevent unraveling of the formwork.

11. The method of claim 10, wherein an outside perimeter of the shell is prevented from expansion so that an internal pressure caused by the reinforcement material increases friction force between the wrapped layers of sheets and the friction will be the main cause of preventing the unwrapping of the wrapped sheets.

* * * * *